US005463860A

United States Patent [19]

Sauer

[11] Patent Number: 5,463,860

[45] Date of Patent: Nov. 7, 1995

[54] PROCESS AND DEVICE FOR PIECING AN OPEN-END SPINNING DEVICE

[75] Inventor: Jurgen Sauer, Ingolstadt, Germany

[73] Assignee: Rieter Ingolstadt Spinnereimaschinenbau AG, Ingolstadt, Germany

[21] Appl. No.: 164,351

[22] Filed: Dec. 9, 1993

[30] Foreign Application Priority Data

Dec. 24, 1992 [DE] Germany ..... 42 44 081.5

[51] Int. Cl.[6] ..... D01H 4/50

[52] U.S. Cl. ..... 57/263

[58] Field of Search ..... 57/263, 261, 352

[56] References Cited

U.S. PATENT DOCUMENTS

| | | | |
|---|---|---|---|
| 3,733,799 | 5/1973 | Roethke | 57/263 |
| 4,628,684 | 12/1986 | Morita et al. | 57/263 |
| 4,676,059 | 6/1987 | Artzt et al. | 57/263 |
| 5,191,760 | 3/1993 | Ball et al. | 57/263 |
| 5,243,812 | 9/1993 | Strobel et al. | 57/263 |

FOREIGN PATENT DOCUMENTS

| | | | |
|---|---|---|---|
| 8601235 | 2/1986 | WIPO . | |
| 92/15735 | 9/1992 | WIPO | 57/263 |

*Primary Examiner*—Joseph J. Hail, III
*Attorney, Agent, or Firm*—Dority & Manning

[57] ABSTRACT

To piece an open-end spinning device, the yarn end is introduced into the spinning rotor while the spinning rotor is stopped. An auxiliary suction air stream prevailing at the opener roller housing takes effect and sucks the yarn into the fiber feeding channel where it is held. The spinning rotor which was stopped until then is then again driven. Following this, the negative spinning pressure is switched on while the auxiliary suction air stream is simultaneously switched off. This causes the yarn end to be taken out of the fiber feeding channel and to be fed to the fiber collection surface of the spinning rotor where it is combined with the fibers which are again conveyed to the fiber collection surface. The yarn is then withdrawn in the form of a continuous yarn through the yarn draw-off pipe and out of the spinning rotor.

8 Claims, 1 Drawing Sheet

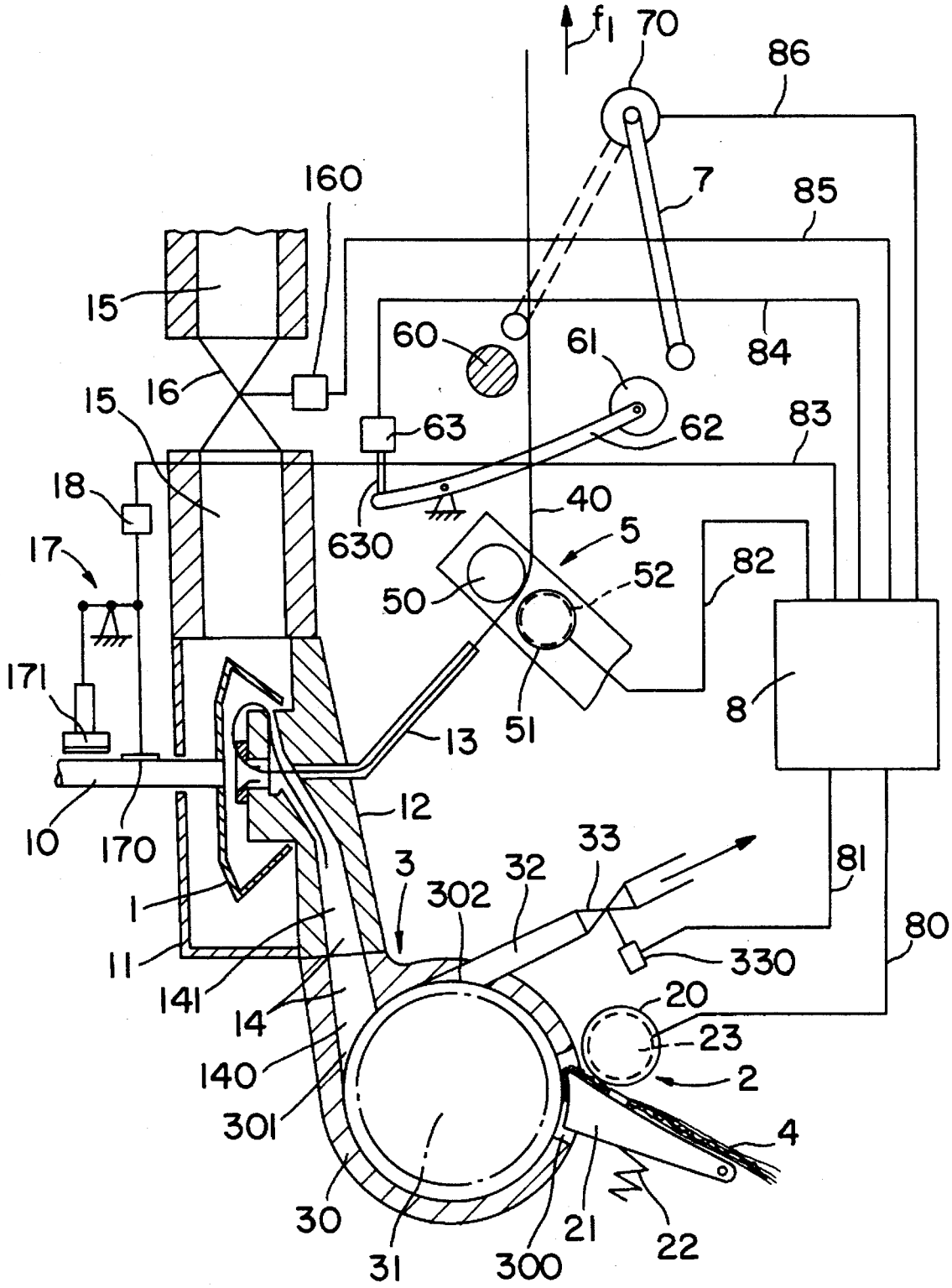
f1
70
86
7
85
160
15
60
61
84
15
16
63
62
83
18
630
40
5
17
50
52
82
171
51
8
13
10
170
12
33
81
3
32
1
302
80
11
330
141
20
14
23
140
2
301
4
30
21
22
31
300

PROCESS AND DEVICE FOR PIECING AN OPEN-END SPINNING DEVICE

BACKGROUND OF THE INVENTION

The instant invention relates to a process for piecing in an open-end spinning device in which a fiber stream is produced and is deflected by means of an auxiliary suction air stream from its course to the fiber collection surface of a spinning rotor until a yarn end is fed back to the fiber collection surface of the spinning rotor. The auxiliary air suction stream is deactivated in coordination with the back-feeding of the yarn end, a negative spinning pressure is produced in the spinning rotor and the fiber stream is fed through a fiber feeding channel to the fiber collection surface of the spinning rotor where the yarn end is united with the newly fed fibers and is then drawn off through a yarn draw-off pipe as fibers are integrated into the yarn. The invention relates as well to a device to carry out this process.

According to a known process of this type (WO 86/01235), a yarn end is introduced with the assistance of a pair of feeder rollers into the yarn draw-off pipe and is then released by the pair of feeder rollers. During this introduction of the yarn end into the yarn draw-off pipe, the negative spinning pressure is switched on in the spinning rotor. In addition an auxiliary negative pressure which is applied to the opener roller housing takes effect in the yarn draw-off pipe. With the spinning rotor running, the fiber feed is then released and the fiber stream thus produced is however prevented by the auxiliary negative pressure from entering the spinning rotor. A yarn reserve is dissolved in that the yarn is thrown off from a throw-off spindle. Because of the auxiliary negative pressure taking effect through the fiber feeding channel, and because of the centrifugal force produced by the rotating spinning rotor, the yarn end which is freed by being thrown off is sucked into the spinning rotor and deposited on its fiber collection surface. In a timed synchronization therewith, the fiber stream is guided into the rotating spinning rotor by switching on the negative spinning pressure and switching off the auxiliary negative pressure, whereby the fibers are united within the spinning rotor with the yarn end which is now drawn off from the spinning rotor and is wound up on a bobbin while the fibers are continuously integrated into the yarn.

The yarn end deposited on the fiber collection surface is twisted by the rotating spinning rotor from the instant of deposit. To avoid over-twisting the yarn end, the latter may remain only for a very short time in the spinning rotor, so that also during its back-feeding to the fiber collection surface the yarn end is exposed for only a short time to this rotation effect. As the yarn is thrown off, the yarn end does reach the fiber collection surface very rapidly, but this back-feeding is undefined with respect to time, as the rapidity with which the yarn end reaches the spinning rotor varies with the yarn number, the fiber material, etc. In addition, the back-feeding of the yarn to the fiber collection surface is also influenced by the rotational position of the throw-off spindle which releases the yarn reserve. Precise timed synchronization with the release of the fiber stream is therefore not possible.

OBJECTS AND SUMMARY OF THE INVENTION

It is therefore a principal object of the instant invention to create a process and a device by means of which precise synchronization between the deposit of the yarn end on the fiber collection surface and the feeding of the fiber stream to the fiber collection surface is made possible easily and reliably. Additional objects and advantages of the invention will be set forth in part in the following description, or may be obvious from the description, or may be learned by practice of the invention.

Time objects are attained through the invention in that the yarn end is introduced into the spinning rotor while the spinning rotor is standing still and while the auxiliary suction air stream takes effect and is sucked from there into the fiber feeding channel and held there, in that the spinning rotor which has been standing still until then is again driven, in that the negative spinning pressure is then switched on while the auxiliary suction air stream is switched off and in that the yarn end is taken from the fiber feeding channel and is fed to the fiber feeding surface of the spinning rotor where is combined with the fibers which are again being fed to the fiber collection surface.

Since the spinning rotor does not rotate during the back-feeding of the yarn end into said spinning rotor, the yarn end is not subjected to any centrifugal force and therefore does not come to be deposited on the fiber collection surface of the spinning rotor. Furthermore only the auxiliary suction air stream is taking effect at this point in time and acts upon the yarn end introduced into the spinning rotor through the fiber feeding channel, pulling the yarn end into the fiber feeding channel. When the spinning rotor is thereupon accelerated again to a special piecing speed or to the normal production speed, the centrifugal force which is now building up again cannot act upon the yarn end since it does not have any contact with the rotating fiber collection surface but is held securely in the fiber feeding channel. The time during which the yarn end is held pneumatically is absolutely immaterial, especially since the deflection of the yarn end at the outlets of the yarn draw-off pipe and of the fiber feeding channel, and the thereby produced adhesion of the yarn end to the deflection edges, protects the yarn end against dissolution. When the negative spinning pressure in the spinning rotor has been brought into action and the auxiliary suction air stream has been switched off as the spinning rotor reaches the rotational speed desired for piecing, the yarn end suddenly reaches the fiber collection surface. At the same time the fiber stream also reaches the rotating fiber collection surface since it is no longer deflected and removed because of the changed negative pressure conditions. A special timed coordination between yarn back-feeding and release of the fiber feeding to the fiber collection surface is not required here, since this synchronization occurs automatically.

The piecing joint length can be determined easily through the length of the yarn end which was fed back into the fiber feeding channel and was retained there.

Since the back-feeding of the yarn end into the spinning rotor does not simultaneously cause the yarn end to be deposited on the fiber collection surface, the yarn back-feeding need not proceed at a back-feeding speed that is synchronized with piecing. Rather, the yarn end can be fed into the fiber feeding channel at a freely optional back-feeding speed so that the latter can be adapted entirely to the requirements of yarn back-feeding. For example, back-feeding of fine yarns can be faster than that of rough yarns, so that the latter can be introduced safely into the fiber feeding channel and can be held there with its end in spite of their greater rigidity.

To be certain that the yarn end can be introduced into the fiber feeding channel in a straight position, an advantageous embodiment of the invention provides for the back-feeding of the yarn through the spinning rotor and into the fiber feeding channel be progressive. Thanks to this slower back-feeding of the yarn end into the spinning rotor and then into the fiber feeding channel, the yarn end has sufficient time to follow the deflection provided by the outlets of the yarn draw-off pipe and the fiber deflection channel without danger that the yarn end may fly past the outlet of the fiber feeding channel due to inertia, for example, and is then pulled into the fiber feeding channel in the form of a loop, with the ensuing risk that the loop may not be able to open again.

Preferably the progressive back-feeding of the yarn end through the spinning rotor and into the fiber feeding channel is controlled by means of a drivable roller.

The introduction of the yarn end into the fiber feeding channel takes place while the negative spinning pressure is switched off. In order to achieve nevertheless reliable introduction of the yarn end into the yarn draw-off pipe, the back-feeding of the yarn end can be carried out in two phases according to the invention, whereby the yarn end is taken in the first back-feeding phase under the combined effect of the negative spinning pressure and of the auxiliary suction air stream into a readiness position within the yarn draw-off pipe, and is taken through the spinning rotor into the fiber feeding channel in the second back-feeding phase under the sole effect of the auxiliary suction air stream.

To make the piecing joint as unobtrusive as possible, the withdrawal of the yarn in the process according to the invention preferably starts already before the yarn end has left the fiber feeding channel and has been deposited on the fiber collection surface.

To carry out the above-described process, the invention provides for a control mechanism by means to which the draw-off device, the yarn back-feeding device, the brake, the negative-pressure line, and the auxiliary suction line are connected for control and which switches on the yarn back-feeding device temporarily while the negative pressure line is not active and the auxiliary suction line and the brake are active, and which takes the auxiliary suction air line out of action and activates the negative pressure line and the draw-off device in synchronization with the release of the spinning rotor by the brake and the switching on of the feeding device. Thanks to the control mechanism according to the invention, piecing can be controlled in such a manner that the yarn end can be brought into a readiness position inside the fiber feeding channel before actual piecing, from which position it is fed together with the fibers to the fiber collection surface for piecing.

In order to be able to securely introduce in particular thicker yarn ends into the fiber feeding channel, provisions are made in an advantageous embodiment of the object of the invention for the fiber back-feeding device to be provided with a drivable roller which causes the progressive back-feeding of the yarn end through the spinning rotor and into the fiber feeding channel, or for the yarn back-feeding device to be provided with a swivelling yarn deflection guide, the swivelling of which causes the yarn to be sucked progressively through the spinning rotor and into the fiber feeding channel.

The object of the invention makes it possible to achieve secure piecing and to determine a defined piecing joint length in a simple manner. Since the back-feeding of the piecing length of the yarn end through the yarn draw-off pipe into the spinning device, is effected independently through the depositing of the yarn end on the fiber collection surface of the spinning rotor, the back-feeding speed of this back-feeding can be selected freely.

A preferred embodiment of the invention is explained in further detail below through a drawing showing a spinning device according to the invention, in a schematic cross-section.

BRIEF DESCRIPTION OF THE DRAWING

The sole FIGURE only shows the elements which are necessary to understand the invention and shows the device according to the invention in schematic cross-section. These elements can be installed in a customary manner either on the open-end spinning machine itself or on a servicing device adapted to travel alongside the machine.

DETAILED DESCRIPTION OF THE PREFERRED EMBODIMENTS

Reference will now be made in detail to the presently preferred embodiments of the invention, an example of which is illustrated in the drawing. The example is provided by way of explanation of the invention, and not limitation of the invention.

The open-end spinning machine consists essentially of a feed mechanism 2, an opener device 3, and a spinning rotor 1 contained in a housing 11.

The feed mechanism 2 in the shown embodiment consists of a feed roller 20 and a feed trough 21 which is pressed elastically against the feed roller 20 by means of a compression spring 22. The feed roller 20 is connected by means of a controllable coupling 23 to a drive which is not shown. A fiber sliver 4 is fed by means of the feed mechanism 2 to the opener device 3 whose most important element is an opener roller 31 located in a housing 30.

The open-end spinning rotor 1 located in the housing 11 extends with its shaft 10 though the bottom of the housing 11 and is mounted in the usual manner, which is not shown here.

The housing 11 is covered by a cover 12 which holds a yarn draw-off pipe 13 that is centered in relation to the spinning rotor 1. Furthermore a part 141 of a fiber feeding channel 14 is installed in the cover 12, the first part 14 of which is located in the housing 30.

The housing 30 is provided with a feed opening 300 in the area of the feed mechanism 2 for the feeding of the fiber sliver 4. Housing 300 is provided with a discharge opening 301 in the area of the fiber feeding channel 14 for the removal of individual fibers, and it is provided after the discharge opening 301 in direction of rotation of the opener roller 31 (arrow f) with an intake opening 302 for intake into an auxiliary suction line 32. A valve 33 which is controlled by means of a suitable actuating drive 330 is installed in the auxiliary suction line 32.

The housing 11 with the spinning rotor 1 is connected to a negative-pressure line 15 by means of which the negative spinning pressure required for spinning can be produced in the housing 11. For this purpose the negative-pressure line 15, as well as the auxiliary suction line 32, are connected to a corresponding negative-pressure source which is not shown. To be able to deactivate or activate the negative spinning pressure as required, a valve 16 with which an actuating drive 160 is associated is provided in the negative-pressure line 15.

The spinning rotor 1 can be driven or braked via its shaft 10. Via a system of rods 17 or simply via suitable controls, a drive belt 170 or a brake 171 can be applied to the shaft 1, and for this one or several suitable drives 18 are associated with the drive belt 170 and with the brake 171 to control the required movements.

A yarn 40 is spun in the customary manner in the spinning rotor 1 and is drawn off from the spinning rotor 1 by means of draw-off rollers 60 and 61 and fed to a bobbin to be wound up (not shown). The draw-off roller 60 is driven while the draw-off roller 61 is pressed elastically against the draw-off roller 60 by elastic means not shown here. The draw-off roller 61 which thus constitutes a pressure roller is mounted on the free end of a two-arm lever 62 the other free end of which can be acted upon by a ram 630 which may be constituted by the armature of a solenoid 63, for example.

The elements mentioned so far are located on the open-end spinning machine itself in the described embodiment.

A yarn presenter 5 is mounted pivotably on a service unit (not shown) which travels alongside the spinning stations of the open-end spinning machine. This yarn presenter 5 is provided with presenting rollers 50 and 51 which can be moved away from each other so that a yarn 40 produced in the spinning rotor 1 can be pulled through the open roller pair. Of the presenting rollers 50, 51, the presenting roller 51 is drivable by means of a motor 52.

In the shown embodiment a reserve hoop 7 is provided after the draw-off rollers 60, 61, in longitudinal yarn direction (arrow $f_1$), which can be brought from the shown rest position (in which the reserve hoop is able to hold a yarn reserve) into the position indicated by broken lines, in which the yarn 40 is released. To be able to carry out this swivelling motion, a swivelling drive 70 is associated with the reserve hoop 7 mounted on the service unit.

As the drawing shows, the coupling 23 of the feed mechanism 2 is connected via a line 80, the actuating drive 330 of the auxiliary suction line 32 via a line 81, the yarn presenter 5 which may also be part of the yarn back-feeding device, via a line 82, the drive 18 (brake 171) via a line 83, the solenoid 63 of the draw-off device (draw-off rollers 60, 61) via a line 84, the actuating drive 160 of the negative-pressure line 15 via a line 85, and the swivel drive 70 (yarn back-feeding device) via a line 86 to a common control device 8 which controls the entire piecing process. Additional lines connected to the elements are provided, but these are not of essential significance for the object to be described here.

During normal production, a fiber sliver 4 is fed in a known manner to the feed mechanism 2, the driven feed roller 20 of which causes the fiber sliver 4 to be fed to the rotating opener roller 31. The opener roller 31 detaches the fibers (not shown) from the forward end of the fiber sliver 4 and conveys the individual fibers into the fiber feeding channel 14. Here the negative spinning pressure produced by means of the negative-pressure line 15 takes effect and causes the fibers to enter the spinning rotor 1 where they separate from the conveying air stream and where they are deposited at the point of greatest inside diameter of the spinning rotor 1 while the conveying air is sucked off over the open edge of the spinning rotor 1 and into the negative-pressure line 15. The end of yarn 40 into which the fibers are continuously incorporated and which is withdrawn from the spinning rotor 1 in the form of a spun yarn is connected to the fibers deposited in the spinning rotor 1 (see arrow $f_A$)

If a yarn breakage occurs for some reason, or if the spinning device has been stopped for other reasons, a piecing procedure must be carried out to initiate the spinning process.

The piecing procedure is normally preceded by a cleaning procedure during which yarn and fiber remnants as well as dirt particles are removed from the spinning rotor 1 which has been stopped in the meantime. During the cleaning procedure the back-feeding of a yarn end into a position in which the yarn presenter 5 can receive the yarn and can bring it to a cutting device where the yarn is cut to the desired piecing length already begins. The yarn presenter 5 then feeds the yarn end to a preparing device where the yarn end is given a form which is optimal for piecing. The yarn presenter 5 then moves into the position shown above the outlet opening of the yarn draw-off pipe 13. The draw-off roller 61 is lifted off the draw-off roller 60 at that moment, so that the yarn 40 is able to reach a position between the two draw-off rollers 60, 61.

During this movement of yarn 40 into its back-fed position and/or during its movement to a point in front of the outlet opening of the yarn draw-off pipe 13, the yarn is laid over the reserve hoop 7 and is held in a path which is deflected in relation to the normal path of the yarn shown in the figure, so that a yarn reserve is formed. The yarn end is then conveyed into the yarn draw-off pipe 13 by joint backward rotation of the bobbin or of another element which delivers the piecing yarn to the spinning device and of the feed rollers 50 and 51.

The negative spinning pressure is active as before for this back-feeding of the yarn end to a readiness position within the yarn draw-off pipe 13, i.e. the valve 16 is opened. In addition, valve 33 is however also opened, so that the combined effect of negative spinning pressure and auxiliary suction air stream causes the yarn to be sucked into the yarn draw-off pipe 13.

The negative spinning pressure is then switched off by closing the valve 16, so that only the auxiliary suction air stream is active in the spinning device. This auxiliary suction air stream acts through the housing 30 and the fiber feeding channel 14 and into the yarn draw-off pipe 13.

The auxiliary roller pair consisting of the feed rollers 50 and 51 is opened. The reserve hoop 7 is then swivelled out of the position indicated by a solid line, whereby the yarn reserve is dissolved as a result of the swivelling motion of the reserve hoop 7. The auxiliary air stream keeps the yarn released by the reserve hoop straight and pulls its end out of the yarn draw-off pipe 13 and into the spinning rotor 1, but so that the yarn end does not reach its circumferential wall, and finally into the fiber feeding channel 14. The yarn movement ends when the reserve hoop 7 releases the yarn.

The yarn now 40 extends from the bobbin (either the bobbin on which the spun yarn was wound or from a special piecing bobbin) between the two draw-off rollers 60, 61 and between the two feed rollers 50, 51 through the yarn draw-off pipe 13 and into the fiber feeding channel 14.

The spinning rotor 1 is now released by the brake 171 as a result of actuation of drive (or drives) 18, while the drive belt 170 is again brought into contact with the shaft 10 of the spinning rotor 1. The spinning rotor 1 thus runs up, it being possible to provide appropriate measures so that the spinning rotor 1 is not brought immediately to full production speed, but only to a somewhat lower piecing speed. An additional drive belt (not shown) driven at piecing speed and used for the time of piecing instead of the drive belt 170 can be provided to drive the spinning rotor 1.

When the spinning rotor has reached the rotational speed provided for piecing (special piecing or full production speed), the coupling 23 is switched on by the control device 8 so that the feed roller 20 again feeds the fiber sliver 4 which had been stopped until then to the opener roller 31 which opens the fiber sliver 4 into individual fibers. The individual fibers are sucked off and removed through the auxiliary suction line 32 by the negative pressure which is active in this line.

When the forward end of the fiber sliver 4, the so-called fiber tuft, has again assumed the form which it has during production, and possibly somewhat earlier, especially with rough yarns, the valves 33 and 16 are switched over at the same time. Thus normal negative spinning pressure is again active in the spinning rotor 1, while the auxiliary suction air stream has-been taken out of action. Therefore an air flow directed from the opener roller 31 into the spinning rotor 1 is produced in the fiber feeding channel 14. This air stream causes the yarn end which had been held until then in the fiber feeding channel 14 to be sucked out of fiber feeding channel 14 and to be deposited on the rotating rotor wall as a result of the centrifugal force produced by the rotating spinning rotor 1, from where the yarn end is deposited into the fiber collection groove at the point of greatest inside diameter of the spinning rotor 1.

Simultaneously with the deposit of the yarn end in the rotating spinning rotor 1, the fibers detached from the fiber tuft by the opener roller 31 now enter the fiber feeding channel 14 and from here go into the fiber collection groove of the spinning rotor 1.

In timed synchronization with the change-over of the air flow in the fiber feeding channel 14, i.e. with the closing of valve 33 and the opening of valve 16, the bobbin which had been stopped until now is again driven in winding direction, so that the yarn end is again withdrawn from the spinning rotor 1. At the same time the fibers are continuously incorporated in a known manner into the continuously withdrawn yarn end.

Upon completion of the piecing procedure, the drive of the spinning rotor 1 is switched over to the shown drive belt 170 if necessary, so that the spinning rotor 1 is brought to normal production speed.

When the piecing yarn has been fed back from a special piecing bobbin for piecing it is cut in a known manner and is thus separated from the piecing bobbin, while the yarn being continuously withdrawn from the bobbin is transferred to the bobbin and is wound up on same. Thus normal production conditions again apply.

The yarn is fed back as mentioned earlier, while the spinning rotor 1 is still stopped. Thus there is no rotor rotation which might cause the yarn end to be over-twisted and therefore no time limits need be respected for technical reasons for the back-feeding of the yarn and for its rest (or sojourn) time within the fiber feeding channel. It is therefore not necessary to carry out back-feeding within the shortest possible period of time. Such a time limit would involve the risk that the yarn end emerging from the yarn draw-off pipe 13 might not be deflected rapidly enough into the fiber feeding channel 14 and might instead fly past its outlet opening at first. In that case, the auxiliary air stream acts first upon an intermediate segment of the back-fed yarn end and pulls it into the fiber feeding channel 14 in form of a loop. With higher yarn numbers, it may prove to be difficult to dissolve this loop, so that the yarn end is also deposited in the form of a loop on the fiber collection surface (fiber collection groove) as the air stream is switched over. This results in disturbances during piecing.

In order to ensure that a good piecing joint is obtained not only with fine yarn thicknesses, where the risk described above does not apply, but also with thicker yarn numbers, a preferred embodiment of the invention provides for the yarn end not to be fed back suddenly but progressively, i.e. slowly, through the spinning rotor 1 and into the fiber feeding channel 14. The yarn end emerging from the yarn draw-off pipe 13 is thus certain to be given sufficient time to follow the auxiliary suction air stream sucked into the fiber feeding channel 14 in a straight state, so that the yarn end therefore assumes a straight position after the completion of back-feeding, while being pneumatically retained in the fiber feeding channel 14 by the auxiliary suction air stream. If the air flow in the fiber feeding channel 14 is subsequently reversed by closing valve 33 and simultaneously opening valve 16, the yarn end can be deposited in an arc shape in the fiber collection groove of the spinning rotor 1 in concordance with the continued emergence from the fiber feeding channel 14.

The progressive, i.e. gradual, back-feeding of the yarn end into the fiber feeding channel 14 can be effected by various different means. In the shown embodiment two means (i.e. feed rollers 50, 51 and reserve hoop 7) which can be used selectively but also in combination with each other are shown.

When the yarn to be pieced is to be unwound again from the bobbin to be presented by the feed rollers 50, 51 in front of the outlet opening of the yarn draw-off pipe 13, subsequent back-feeding of the yarn into the fiber feeding channel 14 can be effected by simultaneous reverse rotation of this bobbin and of the feed rollers 50, 51. It is however also possible to achieve this back-feeding of the yarn by swivelling the reserve hoop 7 back, if such a hoop is provided, with the possibility of further assisting back-feeding with the feed rollers 50, 51, if necessary. In any case, back-feeding of the yarn can be carried out at the desired speed by suitable swivelling the reserve hoop 7 at a corresponding speed or suitable driving of the bobbin—and also the feed rollers 50, 51 if applicable—at a corresponding speed, so that the yarn is certain to enter the fiber feeding channel 14.

The back-feeding of a yarn by means of a roller which drives the bobbin, or which is located at the outlet of the yarn draw-off pipe 13—e.g. the feed rollers 50, 51—is especially advantageous in this case, since the rollers easily ensure defined yarn guidance and back-feeding and result in positive yarn back-feeding.

While yarn back-feeding outside the spinning device is carried out by mechanical means, or is at least controlled by mechanical means, the back-feeding of the yarn in the yarn draw-off pipe 13 or into the fiber feeding channel 14 is pneumatic. In principle, the auxiliary suction air stream which is able to suck the yarn from the position of introduction in front of the yarn draw-off pipe 13 into same and on into the fiber feeding channel 14 suffices for this. The goal is however to ensure that this pneumatic effect is as powerful as possible. For this reason the yarn to be fed back is subjected in a first phase to the combined effect of negative spinning pressure (by means of the open valve 16) and of the auxiliary suction air stream (by means of the open valve 33). The yarn is fed back from the position in front of the outlet of the yarn draw-off pipe 13 into readiness position inside the yarn draw-off pipe 13 by means of this combined suction air effect. The combined effect of the two suction air streams (negative spinning pressure and auxiliary suction air stream) results in a powerful sucking action in front of the outlet of the yarn draw-off pipe 13, so that rapid aspiration of the yarn is achieved.

Once the yarn end is located inside the yarn draw-off pipe 13, the negative spinning pressure is switched off by closing the valve 16. Holding and subsequent and back-feeding of the yarn is effected solely by means of the auxiliary suction air stream which is however entirely sufficient at this point, since it is supplied solely by the air stream flowing in through the yarn draw-off pipe 13 and which carries the yarn with it. This air stream is concentrated in the yarn draw-off pipe 13 and is therefore powerful, so that rapid and reliable slaving of the yarn is ensured.

When the yarn has been fed back sufficiently far into the fiber feeding channel 14, its withdrawal can already start before the yarn end has left the fiber feeding channel 14 and has been deposited in the fiber collection groove. In this manner the sojourn of the yarn end in the fiber collection groove can be shortened. It has been shown that particularly unobtrusive piecing joints are produced in this manner.

It will be obvious to those skilled in the art that various modifications and variations can be made in the present invention without departing from the scope or spirit of the invention. For example, features described as a part of one embodiment can be used with another embodiment to yield a still further embodiment. It is intended that the present invention cover such modifications and variations as come within the scope of the appended claims and their equivalents.

I claim:

1. A process for piecing in an open-end spinning device having a spinning rotor with a fiber collection surface, a yarn draw-off pipe extending from the area of the spinning rotor, a fiber feeding channel for conveying a stream of fibers from an opening device to the spinning rotor, a negative spinning pressure source and an auxiliary suction source, said process comprising the steps of:

stopping the spinning rotor;

conveying a yarn end to the end of the yarn draw-off pipe and sucking the yarn end through the yarn draw-off pipe, through the stopped spinning rotor, and into the fiber feeding channel, whereby the motion of the yarn end into the fiber feeding channel is supported by at least the auxiliary suction source taking effect through the fiber feeding channel and the stopped spinning rotor;

driving the spinning rotor to a piecing spinning speed;

producing a fiber stream and deflecting the fiber stream from the fiber feeding channel by way of the auxiliary suction source; and switching on the negative spinning pressure source while simultaneously switching off the auxiliary pressure source wherein the yarn end is conveyed out of the fiber feeding channel to the fiber collection surface where it is combined with fibers which are again conveyed to the fiber collection surface through the fiber feeding channel.

2. The process as in claim 1, wherein the yarn end is back-fed through the stopped spinning rotor and into the fiber feeding channel in progressive steps.

3. The process as in claim 2, including controlling the progressive feeding of the yarn end into the fiber feeding channel by way of a drivable roller.

4. The process as in claim 1, including back-feeding the yarn end into the fiber feeding channel in two phases, wherein in a first phase the yarn end is brought to a readiness position inside the yarn draw-off pipe by way of the combined effect of the negative pressure source and auxiliary pressure source, and in a second phase the yarn end is conveyed through the spinning rotor and into the fiber feeding channel under the sole effect of the auxiliary source.

5. The process as in claim 1, including commencing withdrawal of the yarn from the spinning rotor before the yarn end has left the fiber feeding channel and has been deposited on the fiber collection surface.

6. A device for piecing in an open-end spinning machine having a spinning rotor with a fiber collection surface, said device comprising:

a feed device for feeding a fiber sliver;

an opener device for opening the fed fiber sliver into individual fibers;

a fiber feeding channel extending from said opener device to said fiber collection surface;

a yarn draw-off pipe extending from the area of said rotor;

a negative spinning pressure source for producing a negative spinning pressure in the area of said spinning rotor;

an auxiliary suction line disposed to suck fibers opened by said opener device away from said fiber feeding channel, when activated, said auxiliary suction line also being capable of drawing a suction through said yarn draw-off pipe, through said rotor, and through said fiber feeding channel;

a spinning rotor brake for stopping the spinning rotor for piecing;

a yarn back-feeding device for feeding a yarn end to be pieced into said spinning rotor, and a yarn draw-off device for withdrawing a yarn produced in said spinning rotor;

a common control device operatively connected to and coordinating at least the operation of said yarn draw-off device, said yarn back-feeding device, said brake, said negative spinning pressure source, and said auxiliary suction line, said control device configured to activate said brake so as to stop said spinning rotor and to temporarily switch on said yarn back-feeding device so as to deliver a yarn end to said yarn draw-off pipe, said control device activating at least one of said negative spinning pressure source or said auxiliary suction line so as to draw said yarn end through said yarn draw-off pipe into said rotor, said control device coordinating and controlling said auxiliary suction line, said brake, and said negative spinning pressure source to draw said yarn end from said rotor into said fiber feeding channel while said negative pressure spinning source is switched off and said spinning rotor is stopped by said brake, said control device further configured to release said brake after said yarn end is in said fiber feeding channel allowing said rotor to be driven to a piecing speed and to subsequently switch off said auxiliary suction line while simultaneously switching on said negative spinning pressure source, said yarn draw-off device, and said feed mechanism so that said yarn end is withdrawn out of said fiber feeding channel and delivered to said fiber collection surface as fibers are conveyed from said opener device through said fiber feeding channel to said fiber collection surface for piecing.

7. The device as in claim 6, wherein said yarn back-feeding device comprises a drivable roller which causes the yarn end to be back-fed to said yarn draw-off pipe.

8. The device as in claim 7, wherein said yarn back-feeding device comprises a swivelling yarn deflection guide having a swivelling motion.

* * * * *